US007370696B2

(12) United States Patent
Al-Muraikhi

(10) Patent No.: US 7,370,696 B2
(45) Date of Patent: May 13, 2008

(54) WELLBORE SYSTEM FOR PRODUCING FLUID

(75) Inventor: Ahmed J. Al-Muraikhi, Alkhogar (SA)

(73) Assignee: Saudi Arabian Oil Company (SA)

( * ) Notice: Subject to any disclaimer, the term of this patent is extended or adjusted under 35 U.S.C. 154(b) by 195 days.

(21) Appl. No.: 10/935,379

(22) Filed: Sep. 7, 2004

(65) Prior Publication Data

US 2006/0048946 A1 Mar. 9, 2006

(51) Int. Cl.
*E21B 43/00* (2006.01)

(52) U.S. Cl. ..... 166/50

(58) Field of Classification Search ..... 166/313, 166/50, 369, 117.5, 272.7
See application file for complete search history.

(56) References Cited

U.S. PATENT DOCUMENTS

| | | | | |
|---|---|---|---|---|
| 2,452,920 | A | 11/1948 | Gilbert | |
| 4,676,313 | A | 6/1987 | Rinaldi et al. | |
| 5,127,457 | A | 7/1992 | Stewart et al. | |
| 6,488,087 | B2 | 12/2002 | Longbottom et al. | |
| 6,571,871 | B2 * | 6/2003 | Lauritzen et al. | 166/227 |
| 2003/0106686 | A1 | 6/2003 | Ingle et al. | |
| 2003/0217842 | A1 | 11/2003 | Zupanick et al. | |

FOREIGN PATENT DOCUMENTS

| | | |
|---|---|---|
| WO | WO 98/50679 A | 11/1998 |

OTHER PUBLICATIONS

Cavender, T, Summary of Multilateral Completion Strategies Used in Heavy Oil Field Development, SPE 86926, XP-002361186, Mar. 16-18, 2004; Society of Petroleum Engineers Inc.

* cited by examiner

*Primary Examiner*—Jennifer H. Gay
*Assistant Examiner*—Robert E Fuller
(74) *Attorney, Agent, or Firm*—Bracewell & Giuliani LLP

(57) ABSTRACT

A well system for producing fluid from an earth formation. A primary wellbore section produces the fluid from the well system to the surface. The primary wellbore section includes a cylindrical member having a number of apertures. At least one flanking wellbore runs substantially alongside the primary wellbore section. The flanking wellbore is in fluid communication with the apertures on the primary wellbore section through the porous earth formation. At least one lateral wellbore section joins the flanking wellbore section. Formation fluid flows into the lateral wellbore sections and then into the flanking wellbore section. The fluid is then transmitted from the flanking wellbore, through the porous earth formation, and is received by the apertures in the primary wellbore section. The fluid flows through the primary wellbore section to the surface.

3 Claims, 3 Drawing Sheets

WELLBORE SYSTEM FOR PRODUCING FLUID

FIELD OF THE INVENTION

The invention relates generally to fluid production within an earth formation, and more particularly to a series of wellbores in fluid communication with each other.

BACKGROUND OF THE INVENTION

Fluids, such as oil, natural gas and water, are obtained from a subterranean geologic formation or porous reservoir by drilling a well that penetrates the fluid-bearing reservoir. This provides a flowpath for the fluid to reach the surface. In order for fluid to be produced from the reservoir to the wellbore there must be a sufficient flowpath from the reservoir to the wellbore. This flowpath is through formation rock of the reservoir, such as sandstone or carbonates, which has pores of sufficient size and number to allow a conduit for the fluid to move through the porous reservoir formation.

In the past, in addition to a principal wellbore extending through the formation, wellbores have been utilized with lateral sections. One technique, referred to as a Maximum Reservoir Contact (MRC) well, comprises a principal wellbore with a plurality of lateral sections extending from it. The principal advantage of a MRC well is its ability to reach a larger area of the reservoir and thus to produce at a substantially higher rate. However, sand from the formation tends to flow into the primary wellbore from the lateral wellbore sections. Combating the problem of sand production associated with the lateral wellbore sections is expensive and difficult, and often is not completely successful.

SUMMARY

Provided is a well system for producing fluid from an earth formation through the well. A primary wellbore section is used to produce the fluid from the well system to the surface. The primary wellbore section has a number of apertures. At least one flanking wellbore is drilled such that a portion of the flanking wellbore runs substantially alongside but is not connected to the primary wellbore section. Each flanking wellbore includes at least one laterally extending wellbore section. The flanking wellbore sections communicate with the primary wellbore section through a portion of the porous earth formation located between the primary wellbore section and the flanking wellbore section.

The fluid is transmitted from the lateral wellbore sections to the flanking wellbore sections, and then through the porous medium of the earth formation, into the primary wellbore section. The fluid is ultimately produced through the primary wellbore section to the surface. The earth formation surrounding the primary wellbore section serves as a sand control medium.

DETAILED DESCRIPTION OF THE INVENTION

Although the following detailed description contains many specific details for purposes of illustration, anyone of ordinary skill in the art will appreciate that many variations and alterations to the following details are within the scope of the invention. Accordingly, the exemplary embodiment of the invention described below is set forth without any loss of generality to, and without imposing limitations thereon, the claimed invention.

Figure 1:
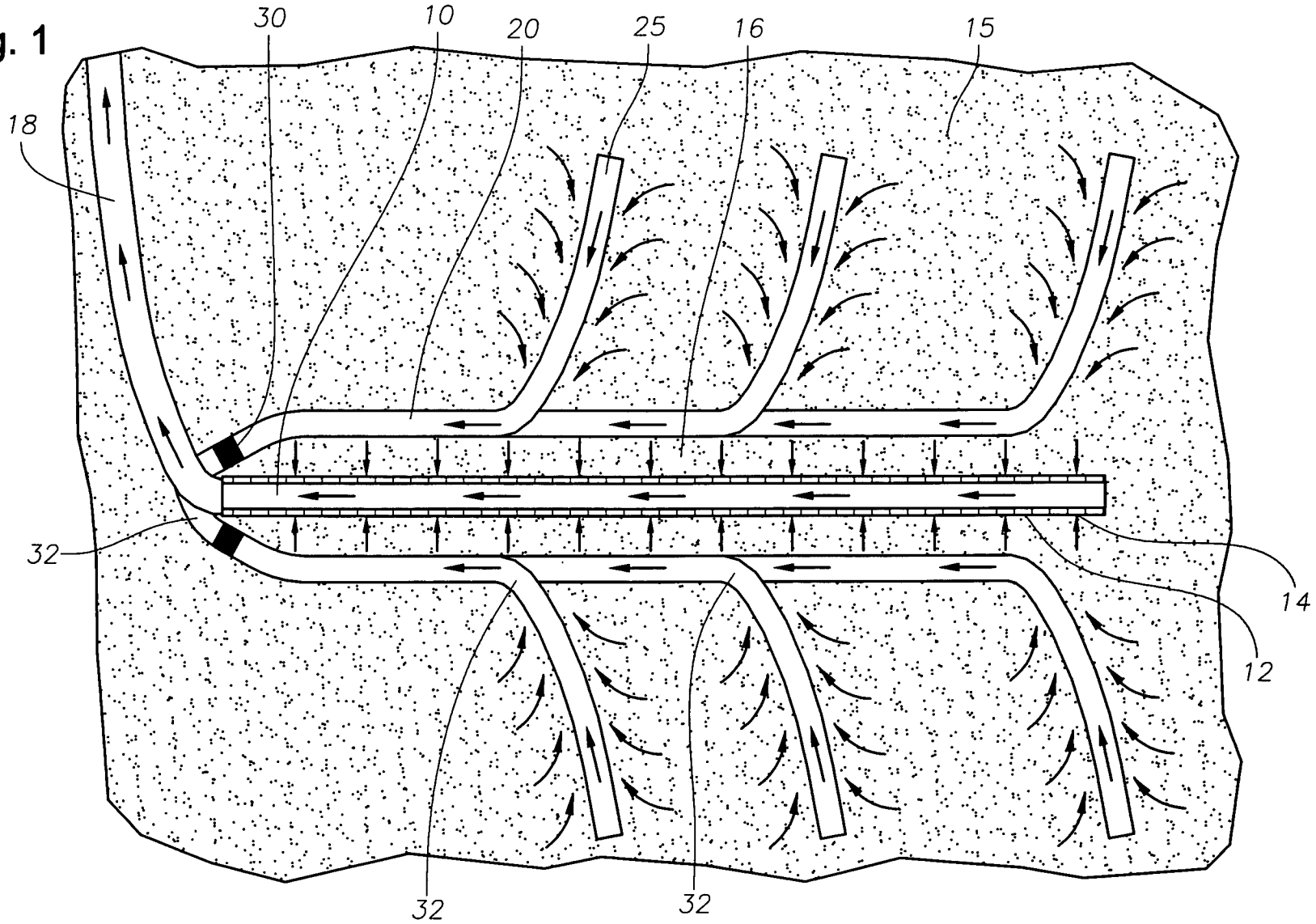
FIG. 1 shows a schematic layout of an embodiment of the wellbore conduit system according to the present invention, where the primary wellbore section is substantially horizontal in orientation.

As shown in FIG. 1, a primary wellbore section 10, as well as at least one flanking wellbore section 20 and at least one lateral wellbore section 25 are drilled into the earth formation 15. The primary wellbore section 10 extends into or through a producing zone 15 and is protected from sand production by a cylindrical member 12 having a number of apertures 14, such as a sand screen, slotted liner, gravel pack, or cemented casing with perforations. The cylindrical member 12 with apertures 14 is used to both prevent the primary wellbore section 10 from collapsing, as well as to prevent sand production into the primary wellbore section 10. Sand screens are utilized as the cylindrical member 12 in the preferred embodiment, and the apertures 14 within the sand screen communicate with the surrounding earth formation.

Figure 2:
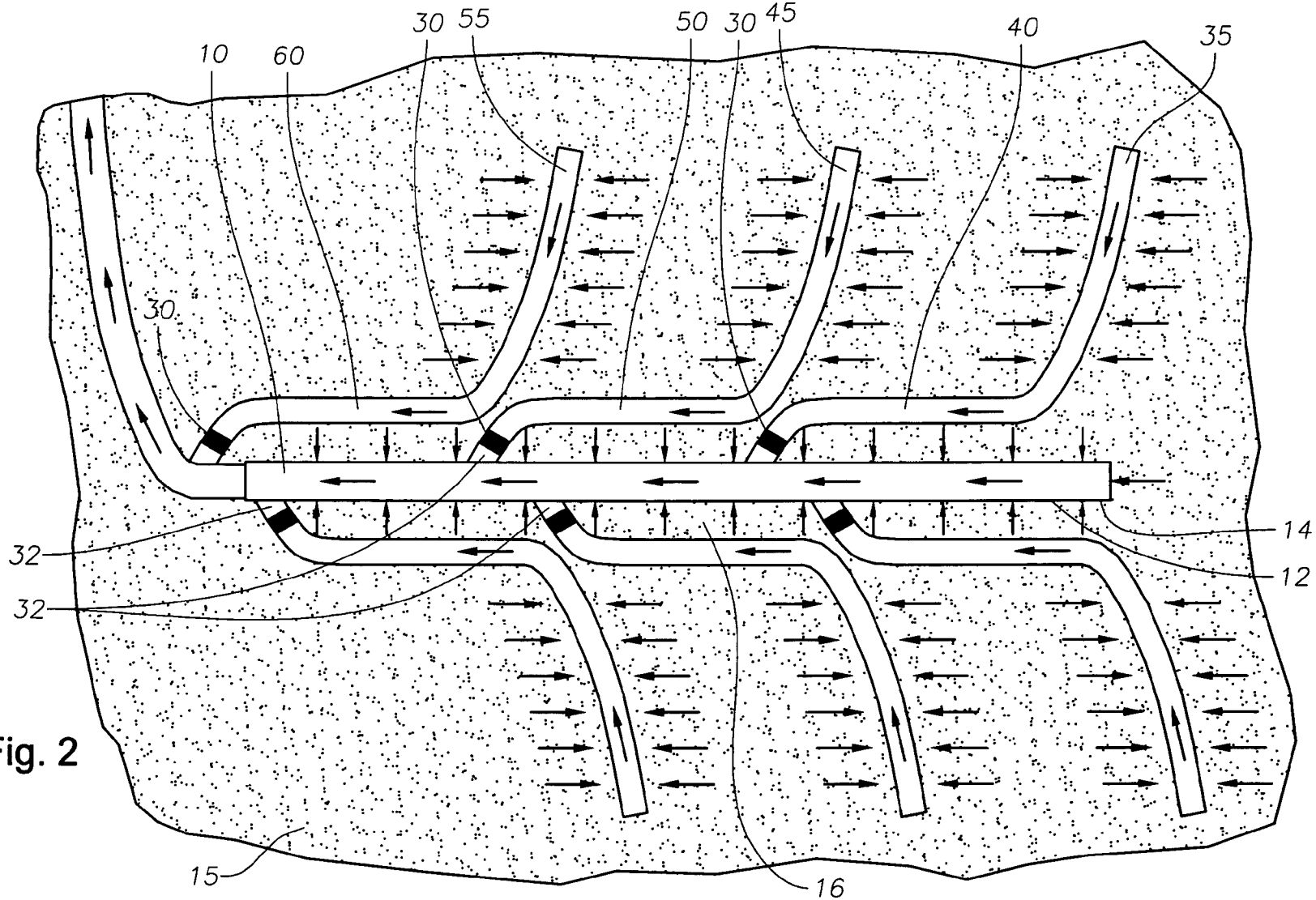
FIG. 2 shows a schematic layout of a second embodiment of the wellbore conduit system, where the primary wellbore section is substantially horizontal in orientation.
Figure 3:
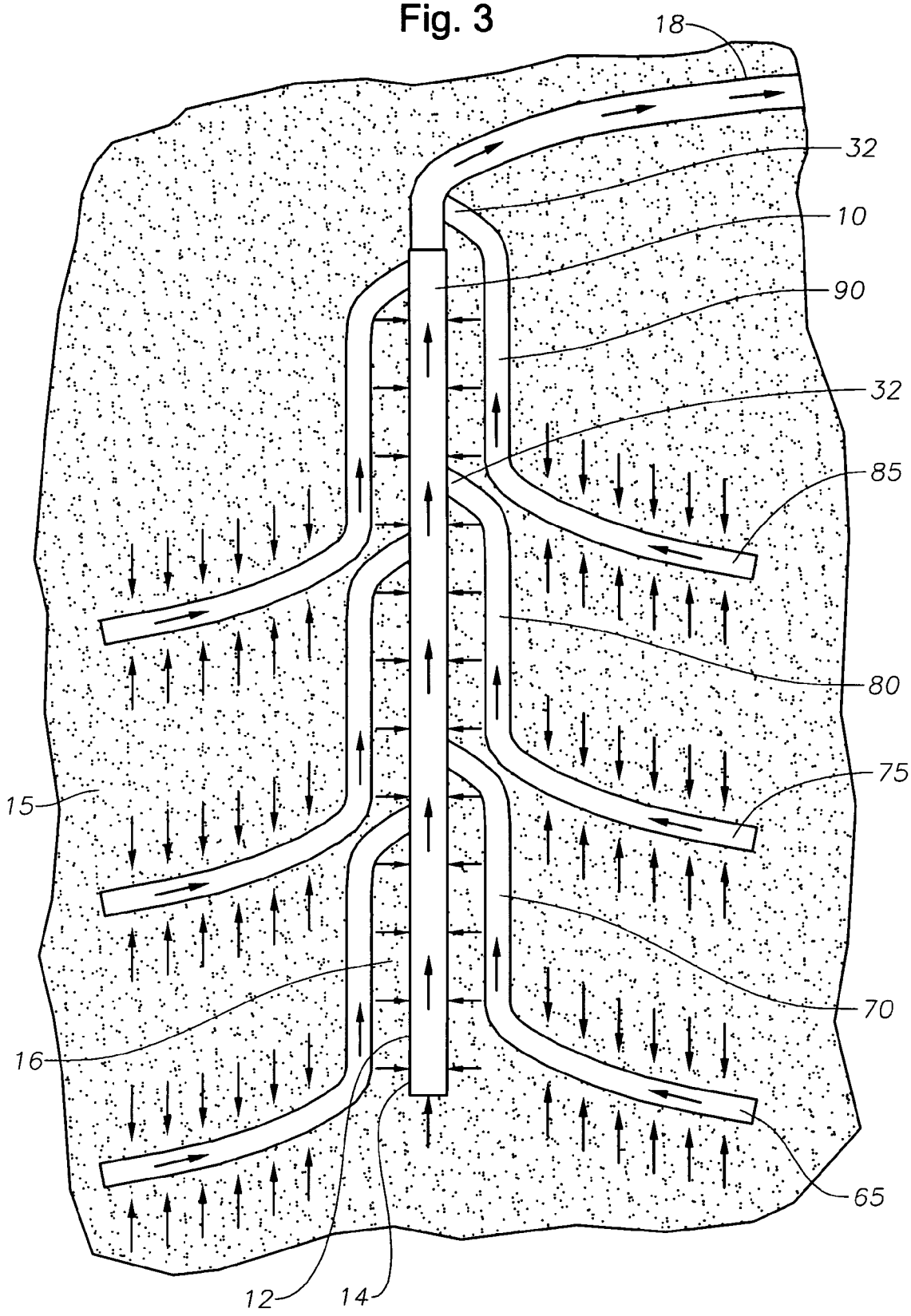
FIG. 3 shows a schematic layout of a third embodiment of the wellbore conduit system, where the primary wellbore section is substantially vertical in orientation.

Primary wellbore section 10 may be horizontal as shown in the embodiments in FIGS. 1 and 2, or vertical as shown in the embodiment in FIG. 3. The primary wellbore section 10 may also be inclined at an angle relative to the horizontal or vertical. Primary wellbore section 10 may be a section extending into the earth formation 15 from a common wellbore 18 that extends toward the surface. Additionally, downhole pumps could be located in primary wellbore section 10.

The flanking wellbore sections 20 extend alongside primary wellbore section 10, except at a side-track point 32 of each flanking wellbore section 20. The side-track point 32 references the location, as shown in FIG. 1, where the flanking wellbore section 20 joins the primary wellbore section 10. Each flanking wellbore section 20 preferably has a casing or slotted liner, with preformed apertures prepared in the casing or liner before installation in the wellbore. Normally the casing or liner would not be cemented. If needed, other embodiments of the flanking wellbore sections 20 may include sand screens or other sand control measures. The flanking wellbore sections 20 may also be drilled and left uncased, without the need for sand control measures.

The flanking wellbore sections 20 form a system of conduits that transport fluid from the reservoir to the primary wellbore section 10. Each flanking wellbore section 20 is substantially parallel to primary wellbore section 10, except for the side-track points 32 where the flanking wellbore sections 20 and the primary wellbore section 10 are joined. In the preferred embodiment, flanking wellbore sections 20 are drilled in a circular pattern with primary wellbore section 10 in the center. Each flanking wellbore section 20 may be approximately the same length as the primary wellbore section 10. As shown in FIG. 1, the flanking wellbore sections 20 may be plugged by plugs 30 near the side-track points 32 to prevent fluid from flowing past the side-track point 32. Some embodiments, however, may join the flanking wellbore sections 20 to the primary wellbore section 10 without utilizing plugs 30, as shown for example in FIG. 3.

The flanking wellbore sections 20 may be alongside the entire length of the primary wellbore section 10 to take full advantage of the whole length of both the primary wellbore section 10 and the flanking wellbore sections 20. The flanking wellbore sections 20 do not intersect or join the primary wellbore section 10 along the length of either the primary or flanking wellbore section, except where the two sections join at the side-track point 32. The flanking wellbore sections 20 are as close to the primary wellbore section 10 as practically achievable. The flanking wellbore sections 20 are preferably substantially parallel to the primary wellbore section 10, but alternatively may be arranged in a slightly slanted or slightly curved disposition relative to the primary wellbore section 10, so long as a portion of the flanking wellbore 20 remains in close proximity with the primary wellbore section 10.

One or more lateral wellbore sections 25 joins and extends outward from the flanking wellbore sections 20 in a direction away from the primary wellbore section 10. The lateral wellbore sections 25 may extend laterally from the flanking wellbore sections 20 in a perpendicular disposition, or may alternatively curve or slant away from the flanking wellbore sections 20 at an angle relative to the perpendicular. Lateral wellbore sections 25 preferably may be as much as a few kilometers long. Preferably several lateral wellbore sections 25 intersect each flanking wellbore section 20 at different locations along the length of the flanking wellbore section 20.

Each lateral wellbore section 25 preferably has a casing or slotted liner, with preformed apertures prepared in the casing or liner before installation in the wellbore. Normally, the casing or liner would not be cemented. If needed, other embodiments of the lateral wellbore sections 25 may include sand screens or other sand control measures. The lateral wellbore sections 25 may also be drilled and left uncased, without the need for sand control measures.

After the flanking wellbore sections 20 and lateral wellbore sections 25 are drilled, the primary wellbore section 10 is drilled, preferably in between the flanking wellbore sections 20. Alternatively, the primary wellbore section 10 may be drilled first, after which the flanking wellbore sections 20 and lateral wellbore sections 25 are drilled on the sides of the primary wellbore section 10. The primary, flanking, and lateral wellbores may be drilled from different wells. Conventional well stimulation methods such as hydraulic fracturing and acid treatment can be applied to maximize their contacts or connectivity with the reservoir.

During production operations, formation fluid flows through the porous side walls of the lateral wellbore sections 25 into the lateral wellbore sections 25. The fluid flows through the lateral wellbore sections 25 into the flanking wellbore sections 20. Formation fluid may also flow directly through the porous side walls of the flanking wellbore section into the flanking wellbore sections 20. The fluid travels through the flanking wellbore sections 20 and out through the porous side walls of the flanking wellbore section 20, into the porous intermediate portion of earth formation 16 surrounding the primary wellbore section 10. The fluid travels through the intermediate porous earth formation 16 until it reaches the apertures 14 within the cylindrical member 12 of the primary wellbore section 10. The primary wellbore section apertures 14 receive the fluid from the intermediate portion of porous earth formation 16, and the fluid travels into and through the primary wellbore section 10 to the surface for production.

The intermediate portion of earth formation 16 between the flanking wellbore sections 20 and primary wellbore section 10 retards sand migration from the flanking wellbore sections 20 to the primary wellbore section 10. The intermediate earth formation 16 in between the primary wellbore section 10 and the flanking wellbore sections 20 is used as a natural barrier to sand production. Since there is no connection or intersection between the flanking wellbore sections 20 and the primary wellbore section 10, sand control measures only need to be provided to the primary wellbore section 10, and sand control measures are thus not necessary for the flanking wellbore sections 20.

In the horizontal well embodiment shown in FIG. 1, many lateral wellbores 25 can extend from a single flanking wellbore 20. The flanking wellbore sections 20 are plugged near the side-track point 32 where the primary and flanking wellbore sections are joined. In an alternative embodiment, shown in the horizontal well embodiment of FIG. 2, each and every succeeding lateral wellbore section 35, 45, 55 has its own distinct flanking wellbore section 40, 50, 60. As such, each flanking wellbore section 40, 50, 60 is shorter in length than the flanking wellbore section 20 in FIG. 1. Also, in the embodiment shown in FIG. 2, each flanking wellbore 40, 50, 60 is pugged with plugs 30 near the multiple side-track points 32 where the flanking wellbore sections 40, 50, 60 join the primary wellbore 10.

In another alternative embodiment, shown in the vertical well embodiment of FIG. 3, each and every succeeding lateral wellbore section 65, 75, 85 has its own distinct flanking wellbore section 70, 80, 90. As such, each flanking wellbore section 70, 80, 90 is shorter in length than the flanking wellbore section 20 in FIG. 1. The sand screen used in connection with the primary wellbore 10 may in some cases be strong enough to prevent sand production through the primary wellbore 10, even if the flanking wellbores 70, 80, 90 are directly connected to the primary wellbore 10. In such a case, there would be no need to plug the flanking wellbores 70, 80, 90. Some of the fluid produced from the flanking wellbores 70, 80, 90 could flow directly into the primary wellbore 10, rather than permeating through the intermediate portion of porous earth formation 16 between the flanking wellbores 70, 80, 90 and the primary wellbore 10.

The embodiments of the invention offer several important advantages, including providing better sand control and lowering costs. It solves the sand control problem by running the flanking wellbore sections alongside the primary wellbore section instead of directly joining or connecting the flanking wellbore sections with the primary wellbore section. In this manner, the advantageous formation of the well system itself acts as a sand screen to prevent sand migration from the flanking wellbore sections to the primary wellbore section. Therefore, as a result, no sand control measures are required for the flanking wellbore sections.

The efficient transmission of hydrocarbons from a large area of the reservoir to the primary wellbore section will ensure higher well rates, larger drainage area, and higher field recovery. The ability to produce at high rates will effectively reduce the number of wells required in developing a field. This result or development is significant because the availability of well slots is generally limited in offshore field development. The invention may also be utilized in tight reservoirs, since the creation of the extensive conduit system will effectively result in higher formation permeability.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The invention claimed is:

1. A well, comprising:

a primary wellbore section adapted to produce fluid, the primary wellbore section comprising a cylindrical member having apertures;

at least one flanking wellbore section running substantially alongside and substantially parallel to the primary wellbore section, wherein a portion of the at least one flanking wellbore section is separated from a portion of the primary wellbore section by part of an earth formation;

the at least one flanking wellbore section being in fluid communication with the surrounding earth formation and with the primary wellbore section apertures through said part of the earth formation therebetween wherein the at least one flanking wellbore section has an end that is plugged; and at least one lateral wellbore section joining and extending laterally from the at least one flanking wellbore section in a direction away from the primary wellbore section, the at least one lateral wellbore section having a side wall in fluid communication with the surrounding earth formation.

2. A well, comprising:

a primary wellbore section adapted to produce fluid, the primary wellbore section comprising a cylindrical member having apertures;

at least one flanking wellbore section running substantially alongside and substantially parallel to the primary wellbore section, wherein a portion of the at least one flanking wellbore section is separated from a portion of the primary wellbore section by part of an earth formation;

the at least one flanking wellbore section being in fluid communication with the surrounding earth formation and with the primary wellbore section apertures through said part of the earth formation therebetween, wherein said at least one flanking wellbore section comprises a plurality of flanking wellbore sections in fluid communication with the primary wellbore section at a plurality of positions along the primary wellbore section; and at least one lateral wellbore section joining and extending laterally from the at least one flanking wellbore section in a direction away from the primary wellbore section, the at least one lateral wellbore section having a side wall in fluid communication with the surrounding earth formation.

3. A well, comprising:

a primary wellbore section adapted to produce fluid, the primary wellbore section comprising a cylindrical member having apertures;

at least one flanking wellbore section running substantially alongside and substantially parallel to the primary wellbore section, wherein a portion of the at least one flanking wellbore section is separated from a portion of the primary wellbore section by part of an earth formation;

the at least one flanking wellbore section having a side wall in fluid communication with the surrounding earth formation and with the primary wellbore section apertures through said part of the earth formation therebetween, wherein the at least one flanking wellbore section is plugged at the side-track point;

a side-track point at an end portion of the at least one flanking wellbore section, the side-track point comprising the position where the end portion of the at least one flanking wellbore section joins the primary wellbore section; and at least one lateral wellbore section joining and extending laterally from the at least one flanking wellbore section in a direction away from the primary wellbore section, the at least one lateral wellbore section being in fluid communication with the surrounding earth formation.

* * * * *